United States Patent [19]

Frye

[11] Patent Number: 4,726,280

[45] Date of Patent: Feb. 23, 1988

[54] MOUNTING OF A MUZZLE MEMBER ON A GUN BARREL

[75] Inventor: Guenter Frye, Erkrath, Fed. Rep. of Germany

[73] Assignee: Rheinmetall GmbH, Duesseldorf, Fed. Rep. of Germany

[21] Appl. No.: 661,068

[22] Filed: Oct. 15, 1984

[30] Foreign Application Priority Data

Oct. 14, 1983 [DE] Fed. Rep. of Germany ..... 3337417

[51] Int. Cl.[4] ..... F41F 17/12

[52] U.S. Cl. ..... 89/16; 89/14.05

[58] Field of Search ..... 89/14.05, 14.1, 14.2, 89/14.3, 14.4, 14.5, 14.6, 16; 42/75 B, 75.02

[56] References Cited

U.S. PATENT DOCUMENTS

| | | | |
|---|---|---|---|
| 2,014,184 | 9/1935 | Linder | 89/14.05 |
| 2,589,171 | 3/1952 | Vironda | 89/14.3 |
| 2,629,958 | 3/1953 | Roper et al. | 89/14.3 |
| 2,662,326 | 12/1953 | Powell | 89/14.3 |
| 2,699,094 | 1/1955 | Musser | 89/14.05 |
| 3,187,632 | 6/1965 | Harvey | 89/14.05 |
| 3,202,056 | 8/1965 | Seeberger | 89/14.3 |
| 3,528,336 | 9/1970 | Donner | 89/14.3 |
| 3,698,747 | 10/1972 | Wing | 285/30.5 |
| 3,732,776 | 5/1973 | Snodgrass | 89/14.5 |
| 4,510,843 | 4/1985 | Rabatin | 89/14.4 |

FOREIGN PATENT DOCUMENTS 0298036 4/1922 Fed. Rep. of Germany ..... 89/14.05

*Primary Examiner*—Stephen C. Bentley
*Assistant Examiner*—Stephen M. Johnson

[57] ABSTRACT

A muzzle member is mounted on the forward end of a gun barrel in such a way that a radial play-free mounting is effected which is secured against rotation and oscillations which occur at firing due to the finishing tolerances of the machined parts of the muzzle member.

This object is achieved by constructing the front end of the gun barrel frusto-conically in front of an external threaded portion and constructing the rear inner portion of the muzzle member frusto-conically. An external threaded portion is provided on the gun barrel and an inner threaded bore portion is provided on the muzzle member for mating meshing mounting. The respective frusto-conical portions of the gun barrel and muzzle member have a length $l_1$ is larger than 1.5 $d_1$ thereby making for a radial play-free joint. The muzzle member is constructed in the longitudinal region $l_1$ of the inner frusto-conical portion in such a way that a firm screwed connection will cause an elastic expansion for receiving a safety locking mechanism in the form of at least four recesses disposed on the outer surface of the frusto-conical forward end of the gun barrel which, in coaction with a rod serve as a rotational locking means.

3 Claims, 2 Drawing Figures

MOUNTING OF A MUZZLE MEMBER ON A GUN BARREL

BACKGROUND OF THE INVENTION

The invention relates to a mounting for a muzzle member on a gun barrel of the type disclosed in German published Patent DE-PS No. 1230334. Such known muzzle member is mounted by means of two separate parts that are threadably mounted, one behind the other, on the free end of the gun barrel and are secured against loosening by rotation. An outer frusto-conical portion of one member includes longitudinal slits whereby the muzzle member is threadably mounted via extending portions of the member which are biased against an outer conical surface of the free end of the gun barrel and thereby are spread apart in such a way that they permit a rotation of the muzzle member relative to a rotational locking in the form of at least one pair of spring tongues defining a gap.

It is known that such muzzle member is tightly mounted on the gun barrel, because if such muzzle member is not sufficiently tightly mounted there inevitably occurs a reduction of the impact precision of a projectile fired therethrough.

This method of mounting a muzzle member has been found to have drawbacks. In particular the extensions forming a conical surface, in view of their slitted construction, present a relative yieldable stop member for the locked threaded connection, whereby the muzzle member can be secured against loosening by rotation and can be fixed in an axial direction, but the radial mobility of the muzzle member in the region of the free forward end of the gun barrel is only insignificantly influenced. This radial mobility is possible because, on the one hand, in front and behind the locking thread, as a result of the necessary flanking play movement the internal thread of the muzzle member must be centered via cylindrical bore surfaces, whereby there must be present a radial play between the bore surfaces and the gun barrel for purposes of providing a threaded mounting possibility of the muzzle member. On the other hand, according to tests, it has been established that such stressing of the meshing threads causes the forces absorbed by the threaded connection to be only poorly absorbed by the threads, whereby the loading of the threaded connection towards the gun barrel muzzle is already significantly reduced after a few threads so that the preponderant number of threads are only slightly or not at all loaded and therefore at firing radial oscillations can not be avoided during projectile guidance at the front end of the barrel. Thereby there can, for example, occur swing amplitudes at a muzzle outlet forming part of a muzzle brake which is arranged in front of the gun barrel free end which exceed the guide play about the strongly prestressed region of the frusto-conically shaped free end of the gun barrel. Directional deviations of the projectile and impact precision reduction is as a result of such phenomena.

SUMMARY OF THE INVENTION

In contradistinction thereto the invention has as an object to provide a mounting for a muzzle brake member of a gun barrel which is improved in such a way that between the muzzle outlet portion and the gun barrel there is provided in addition to an axial fixing and a safety lock against rotation a radially play-free joining due to oscillations of the muzzle outlet portion at firing, which oscillations may occur due to finishing tolerances of the connecting elements.

This object is advantageously achieved by means of a simple, play-free and rugged type of joining between the outlet portion of the muzzle and the gun barrel. In the forward region of the gun barrel, the muzzle brake member and gun barrel are joined to each other over relatively long conical surfaces in a play-free manner. The conical surfaces and the rotational locking means are further advantageously insulated from exterior forces so that at all times an exchange of the muzzle member is possible. Additional guide means as well as long mounting threads are eliminated by the type of mounting of this invention.

BRIEF DESCRIPTION OF THE DRAWING

With these and other objects in view, which will become apparent in the following detailed description, the present invention, which is shown by example only in the accompanying drawing, will be clearly understood.

DETAILED DESCRIPTION

Figure 1:
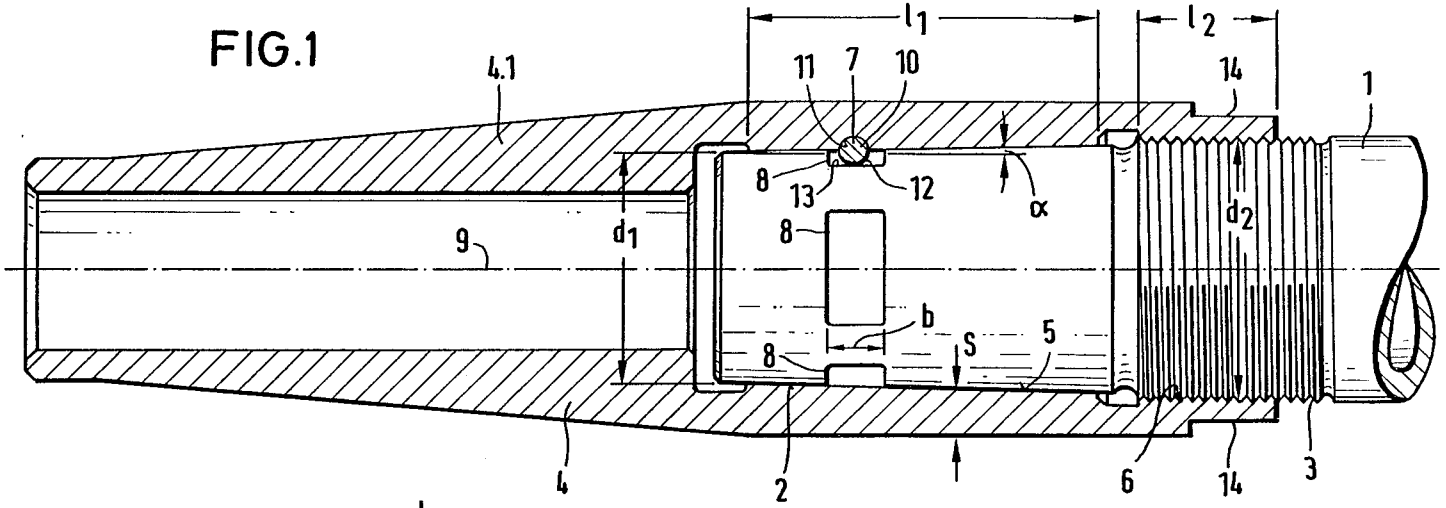
FIG. 1 the drawing illustrates in longitudinal cross-section the muzzle member of the invention shown as mounted on the free end of a gun barrel.
Figure 2:
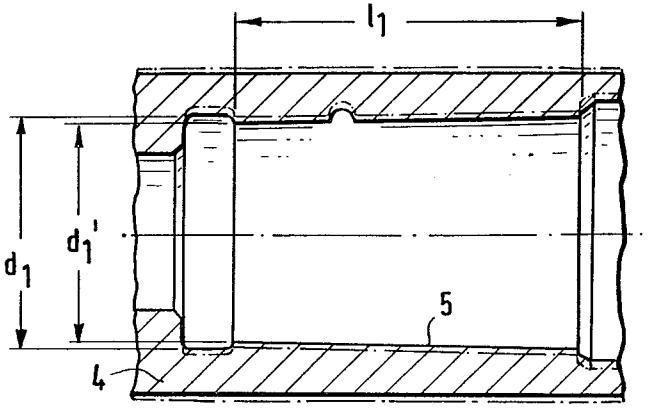
FIG. 2 is a partial cross-sectional view of the muzzle member of FIG. 1 showing its elastic deformation.

There is illustrated a muzzle member 4 constructed as a muzzle brake 4.1, which has a rear line threaded portion 6 and an internal frusto-conical portion 5. The gun barrel forward end has, on the other hand, an external threaded portion 3 which mates with the inner threaded portion 6. The external threaded portion 3 is disposed behind an external frusto-conical portion 2 of the gun barrel, which constitutes the forward end thereof. The gun barrel frusto-conical portion 2 is matingly shaped with respect to the inner frusto-conical portion 5 of the muzzle member 4 so that when the muzzle member 4 is threadably mounted on the external threaded portion 3 via the inner threaded portion 6 there results a rugged, prestressed and thereby durable connection. This connection is thereby made radially play-free, because the inner cone 5 and the outer cone 2 over a length $\mathbf{1}_1$ which is larger than 1.5 $d_1$ and has the same angle of inclination $\alpha$ which effects a self-locking. The threaded portions 3, 6, are constructed as fine threads in order to mount and dismount the self-locking conical connection. The threaded portions 3, 6 assume only certain predetermined support functions for the muzzle member 4 so that the axial length $\mathbf{1}_2$ is smaller than the thread diameter $d_2$.

The outer frusto-conical gun barrel portion 2 of the gun barrel 1 includes at least four transverse recesses 8 equally angularly spaced about the periphery of the portion 2 which recesses 8 serve for acting as a rotational safety lock 7. The rotational safety lock 7 includes a safety rod 10 which is deposited in cutout 11 when the conical joint is in its safety position, which bore 11 is transverse to the axis 9 and also tangential to the inner frusto-conical portion 5. Thereby, by means of the part 12 of the rod 10, which extends into the space of the inner frusto-conical portion 5 along the flat bottom 13 of the recess 8 there is obtained a locking action. The strength and wall thickness S of the inner-frusto-conical portion 5 of the muzzle member 4 is selected in the longitudinal region $\mathbf{1}_1$ in such a way relative to the angle of inclination $\alpha$ and the thread angle, that when firmly screwing on the muzzle member 4 by means of known mounting tools (not illustrated) there is effected on the parallel surfaces 14 of the muzzle member 4 a certain elastical enlargement of the muzzle member 4 in the region $1_1$ for assuming a locking position in one of the recesses 8 of the lock 7. The width b of the bottom 13 of the recess 8 is dimensioned is such a way that, after contacting of the conical surfaces 2, 5 and the resulting further rotation of the muzzle member 4 into the next locked position the rod 10 is slit into the bore 11 which is parallel to the recess 8 for securing the muzzle member 4.

Although a single embodiment of the invention has been illustrated in the accompanying drawing and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

I claim:

1. An improved mounting arrangement for a muzzle member coaxially mounted on the free end of a gun barrel having a frusto-conically shaped outer surface, said muzzle member having a mating inner frusto-conical shaped bore, said muzzle member and free end of the gun barrel also having respective mating threaded bore and threaded outer surface portions so that when said muzzle member is threadably mounted on the free end of the gun barrel said frusto-conically shaped outer surface and said inner frusto-conically shaped bore abuttingly contact each other, said frusto-conically shaped outer surface on the free end of the gun barrel having rotational locking means, the improvement comprising, (a) said frusto-conically shaped outer surface is disposed on the front most portion of the free end of said gun barrel in front of said threaded outer surface portion and said inner frusto-conically shaped bore is disposed in front of said threaded bore portion;

(b) said inner frusto-conically shaped bore and said frusto-conically shaped outer surface when in abutting contact form a radially play-free self-locking joint having an axial length $l_1 \geqq 1.5\ d_1$ ($d_1$ being the diameter of the front most portion of the free end of the gun barrel) so that no relative movement of the muzzle member relative to the free end of the barrel may occur over the length $l_1$;

(c) the inner frusto-conically shaped bore of the muzzle member is shaped over the axial $1_1$ in such way that when said threaded bore portion is firmly threadably mounted on said threaded outer surface portion said frusto-conically shaped bore portion is elastically spread apart for permitting the sliding therepast of said rotational locking means; and (d) when said muzzle member is rotationally locked by said rotational locking means at least a part of said rotational locking means is disposed in one of at least four segment-like recesses on said frusto-conically shaped outer surface.

2. The improvement in a mounting arrangement for a muzzle member coaxially mounted on the free end of a gun barrel as set forth in claim 1, wherein said rotational locking means includes at least one rod disposed transversely with respect to the longitudinal axis and tangentially with respect to the periphery of said frusto-conically shaped inner bore, whereby said rod, when in its rotational locking position, has a portion extending into said frusto-conically shaped inner bore which portion extends also along the bottom of one of said segment-like recesses.

3. The improvement in a mounting arrangement for a muzzle member coaxially mounted on the free end of a gun barrel as set forth in claim 2, wherein said threaded bore portion and said threaded outer surface portion have fine machined threads and relatively short length $1_2$ which is smaller than the thread diameter $d_2$.

* * * * *